US007204389B2

(12) United States Patent
Smith

(10) Patent No.: US 7,204,389 B2
(45) **Date of Patent: *Apr. 17, 2007**

(54) LIDDED CONTAINER

(75) Inventor: Randall J. Smith, North Kansas City, MO (US)

(73) Assignee: Marcon Marketing Concepts, Inc., North Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/908,248

(22) Filed: May 4, 2005

(65) Prior Publication Data

US 2005/0184082 A1 Aug. 25, 2005

Related U.S. Application Data

(63) Continuation of application No. 10/605,800, filed on Oct. 28, 2003, now Pat. No. 6,889,867.

(51) Int. Cl.
*B65H 1/00* (2006.01)

(52) U.S. Cl. ..... 221/33; 221/63; 221/306

(58) Field of Classification Search ..... 221/63, 221/33, 306; 220/256, 259, 288, 295, 304, 220/795, 378, 780, 833, 837, 845
See application file for complete search history.

(56) References Cited

U.S. PATENT DOCUMENTS

| | | | | | |
|---|---|---|---|---|---|
| 4,171,047 | A * | 10/1979 | Doyle et al. | ..... | 206/210 |
| 4,219,129 | A * | 8/1980 | Sedgwick | ..... | 221/63 |
| 4,651,895 | A * | 3/1987 | Niske et al. | ..... | 221/63 |
| 5,467,893 | A * | 11/1995 | Landis et al. | ..... | 221/34 |
| 5,549,213 | A * | 8/1996 | Robbins et al. | ..... | 220/8 |
| 5,718,353 | A * | 2/1998 | Kanfer et al. | ..... | 221/63 |
| 5,908,138 | A * | 6/1999 | Vlahakis et al. | ..... | 221/63 |
| 6,105,807 | A * | 8/2000 | McCrossen | ..... | 220/288 |
| 6,138,867 | A * | 10/2000 | Stelmack | ..... | 221/63 |
| 6,152,322 | A * | 11/2000 | Marino | ..... | 221/63 |
| 6,182,858 | B1 * | 2/2001 | Hartog | ..... | 221/63 |
| 6,279,775 | B1 * | 8/2001 | Parkes et al. | ..... | 221/63 |
| 6,554,156 | B1 * | 4/2003 | Chong | ..... | 221/63 |
| 6,889,867 | B1 * | 5/2005 | Smith | ..... | 221/33 |

* cited by examiner

*Primary Examiner*—David H. Bollinger
(74) *Attorney, Agent, or Firm*—Hovey Williams LLP

(57) ABSTRACT

A moist product dispenser (10) comprising a lid (12) coupled with a container (14) is disclosed. The lid (12) comprises a circumferential seal slidably received on the container sidewall (18) for preventing moisture loss from the container interior. The seal generally comprises a circumferential ridge (20) having top and bottom faces (24, 26) and is configured for nonthreaded engagement with the container sidewall (18).

27 Claims, 4 Drawing Sheets

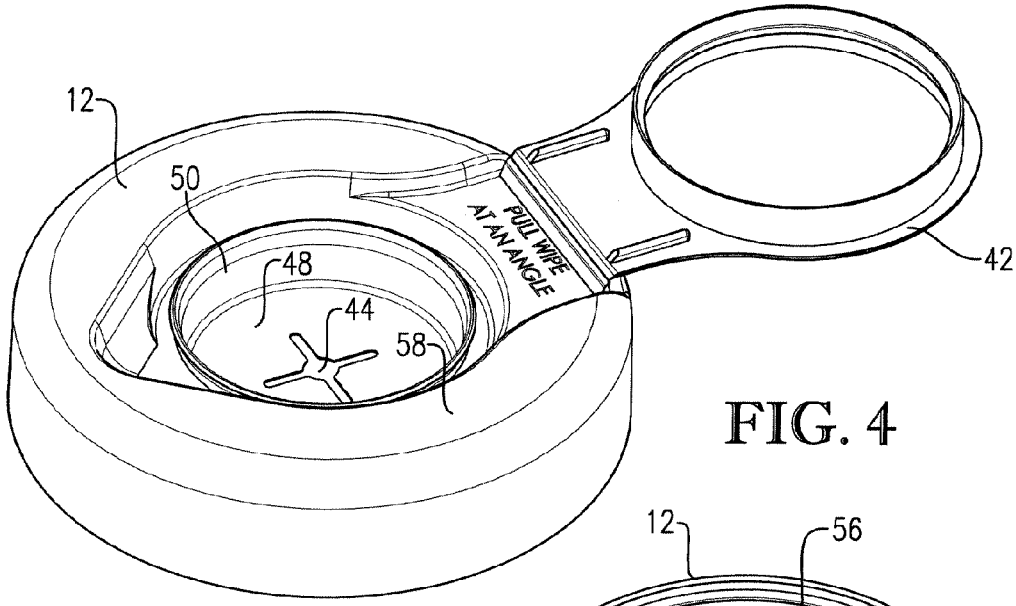
FIG. 4
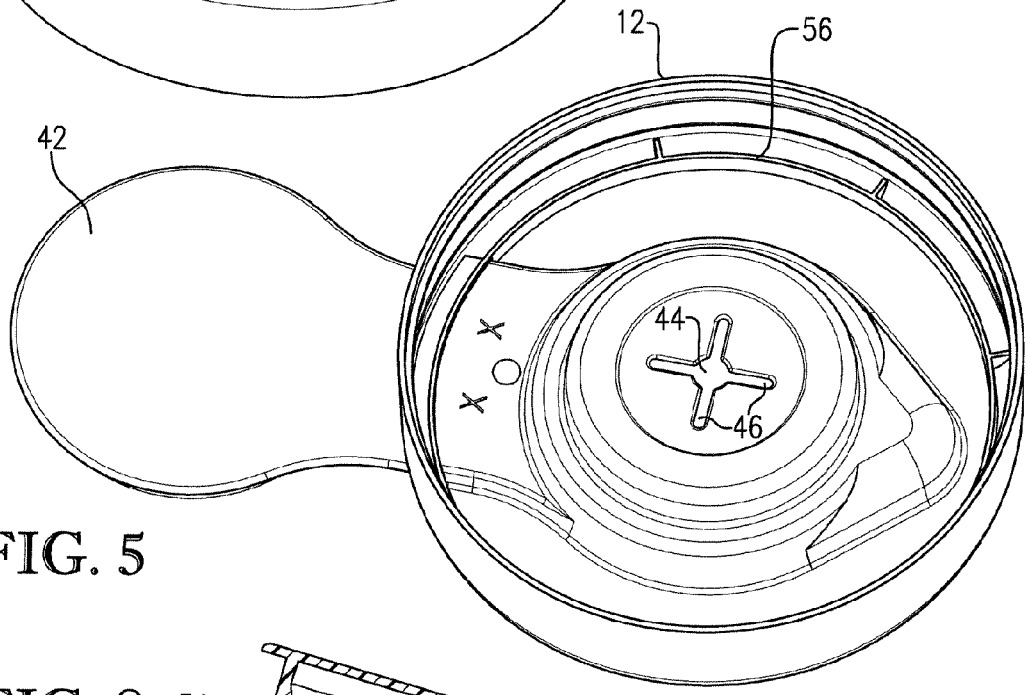
FIG. 5
FIG. 8
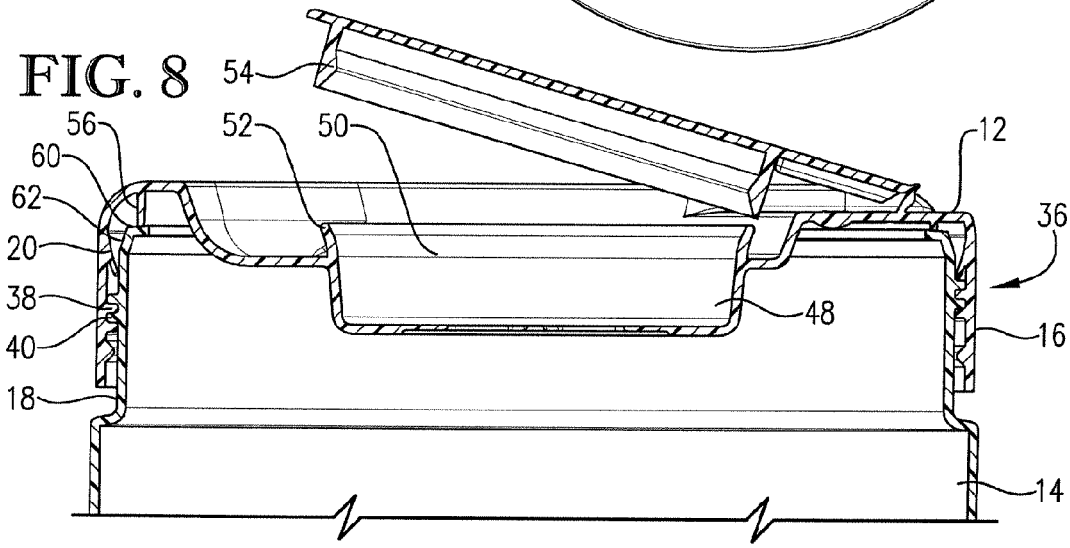

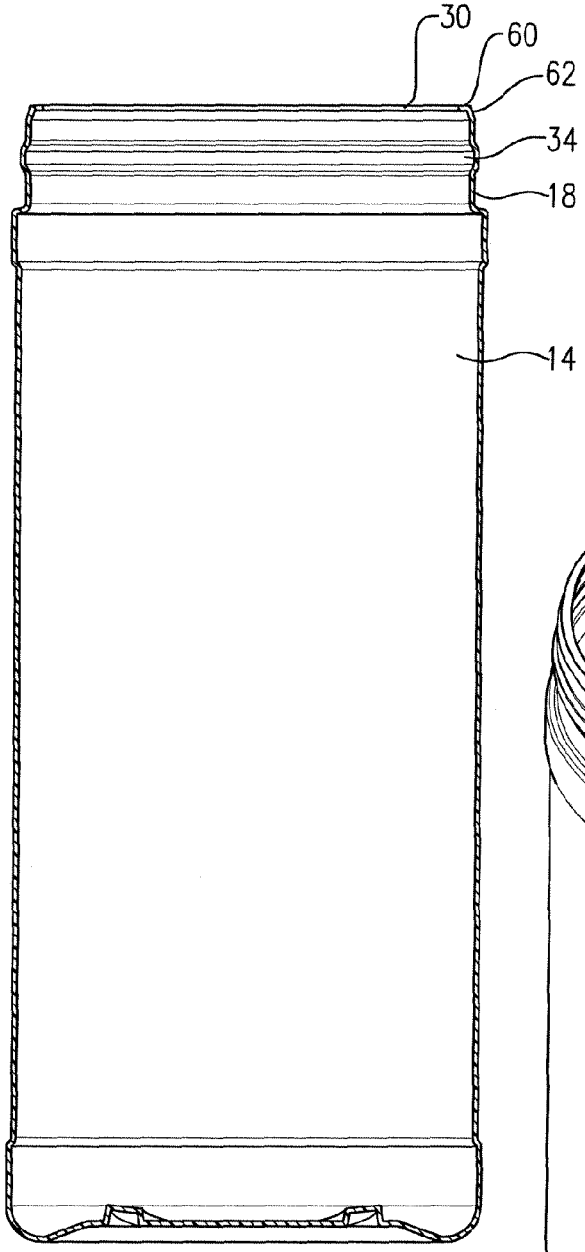
FIG. 6
FIG. 7
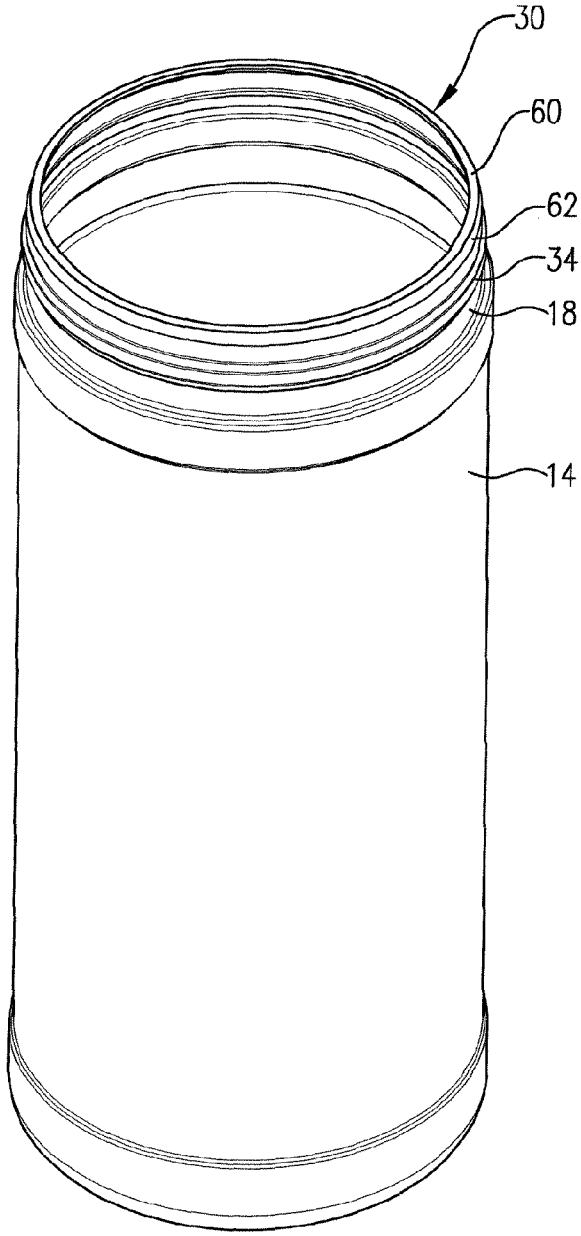

LIDDED CONTAINER

RELATED APPLICATIONS

This is a continuation of application Ser. No. 10/605,800 filed Oct. 28, 2003 now U.S. Pat. No. 6,889,867, which is hereby incorporated by reference herein.

BACKGROUND OF THE INVENTION

1. Field of the Invention

The present invention is generally directed toward an improved lidded container particularly suited for storing and dispensing a moist product such as moist cleaning wipes. The dispenser lid comprises an improved seal to prevent moisture loss from inside the container.

2. Description of the Prior Art

Premoistened cleaning wipes have become increasingly popular because of the convenience they provide. Such wipes generally comprise a web material (natural or synthetic fibers) moistened with a quantity of cleaning fluid suitable for a particular purpose. Oftentimes, this cleaning fluid comprises a relatively volatile chemical, like alcohol, which tends to evaporate when left exposed to the atmosphere. The wipes are generally provided in a resealable, plastic container with the container also serving to assist in dispensing the wipes in a selective manner. An exemplary wipe dispenser is depicted in U.S. Pat. No. 6,554,156.

Conventional wipe dispensing containers are not particularly suited for extended storage of the moist product in that moisture tends to escape from the container interior causing the product to dry out. Not only does this present an inconvenience to the consumer, but also results in increased expense in that the dried-out product is no longer suitable for the purpose for which it was intended and must be discarded.

There exists a real and unfulfilled need in the art for a moist product dispenser that prevents moisture loss from the container interior. Furthermore, such a moisture loss prevention system should not substantially increase the manufacturing costs of the dispenser and should be able to operate effectively with dispensers manufactured according to varying tolerances.

SUMMARY OF THE INVENTION

The present invention overcomes the foregoing problems and provides a moist product dispenser comprising a specially adapted seal for preventing moisture loss from the container interior.

In one aspect of the invention, the moist product dispenser comprises a container having an interior for storing the moist product and presenting a circumferential sidewall. The dispenser further comprises a lid coupled with the container. The lid comprises a circumferential lid sidewall presenting an interior surface. The interior surface includes a circumferential, protruding ridge presenting top and bottom faces. The top and bottom faces obliquely and substantially co-directionally slope away from the lid sidewall interior surface. The ridge is adapted for contacting the container sidewall and forms a flexible seal between the container and the lid.

In another aspect of the invention, the moist product dispenser comprises a container having an interior for storing the moist product and presenting a circumferential container sidewall. The dispenser further comprises a lid coupled with the container, the lid presenting a circumferential lid sidewall having an interior surface. The lid further presents a top wall and includes a dispensing port formed in the top wall which communicates with the container interior. The lid comprises a hinged flap moveable between a closed position wherein the flap is in covering relationship to the port and an open position whereby the port is uncovered. The lid further comprises a flexible ridge protruding inwardly from the lid sidewall interior surface and is in nonthreaded engagement with the container sidewall and provides a seal between the container and the lid for preventing moisture loss from the container interior.

As noted above, in one aspect of the invention, the flexible ridge presents top and bottom faces which obliquely and substantially co-directionally slope away from the lid sidewall interior surface. Preferably, the top and bottom faces slope in a generally downward direction away from the lid sidewall interior surface and lie in converging planes. However, it is within the scope of the present invention for each face to lie in spaced but parallel planes that obliquely slope away from the lid sidewall interior surface. It is also preferred for the inner diameter of the flexible ridge to be less than the outer diameter of the container sidewall proximate the container orifice. Furthermore, the bottom face and lid sidewall interior surface cooperatively define a circumferential channel which allows for flexing of the ridge when slidably engaged with the container sidewall. This particular arrangement allows the ridge to accommodate and provide an effective seal with containers manufactured according to relatively unexacting tolerances.

Preferably, the product dispensing port formed in the top wall of the lid comprises a plurality of intersecting slots serving to hold the product as it is being dispensed, however, any suitable shape is acceptable.

The lid and container may be secured together by any conventional means, however, snap-down fastening systems and screw-down fastening systems are preferred. In embodiments employing a snap-down fastening system, the container presents an outwardly protruding rib formed in the container sidewall proximate the orifice. A second ridge is provided on the interior surface of the lid sidewall which cooperates with the protruding rib to lock the lid in place over the container. Preferably, the flexible ridge nonthreadably engages the container sidewall between the top orifice and the rib.

In embodiments employing a screw-down fastening system, the container sidewall and lid comprise complimentary threading for securing the lid to the container. As the lid threads engage the container threads, the flexible ridge is forced down over the container sidewall and forms a seal between the lid and container.

Preferably, the container sidewall comprises a beveled section proximate the container top orifice. The beveled section presents a downwardly divergent slope away from the top orifice and helps to facilitate coupling of the lid and the container. The beveled section also assists in maintaining the orientation of the flexible ridge during the coupling process so that an effective seal between the lid and container is formed.

The lid is preferably formed of a synthetic resin material through an injection molding process. Likewise, the container is preferably formed of a synthetic resin material, however a blow molding process is the preferred method of manufacture.

BRIEF DESCRIPTION OF THE DRAWINGS

FIG. 4 is a perspective view of the top of the lid with the lid flap in the open position.

FIG. 5 is a perspective view of the bottom of the lid with the lid flap in the open position.

FIG. 6 is a cross-sectional view of the dispenser container detached from the lid.

FIG. 7 is a perspective view of the dispenser container.

FIG. 8 is a fragmentary cross-sectional view of an alternative embodiment of the invention, wherein the lid is secured to the container with a screw-down fastening system.

DETAILED DESCRIPTION OF THE PREFERRED EMBODIMENT

The following description sets forth preferred moist product dispensers in accordance with the present invention. It is to be understood, however, that this description is provided by way of illustration and nothing therein should be taken as a limitation upon the overall scope of the invention.

Figure 1:
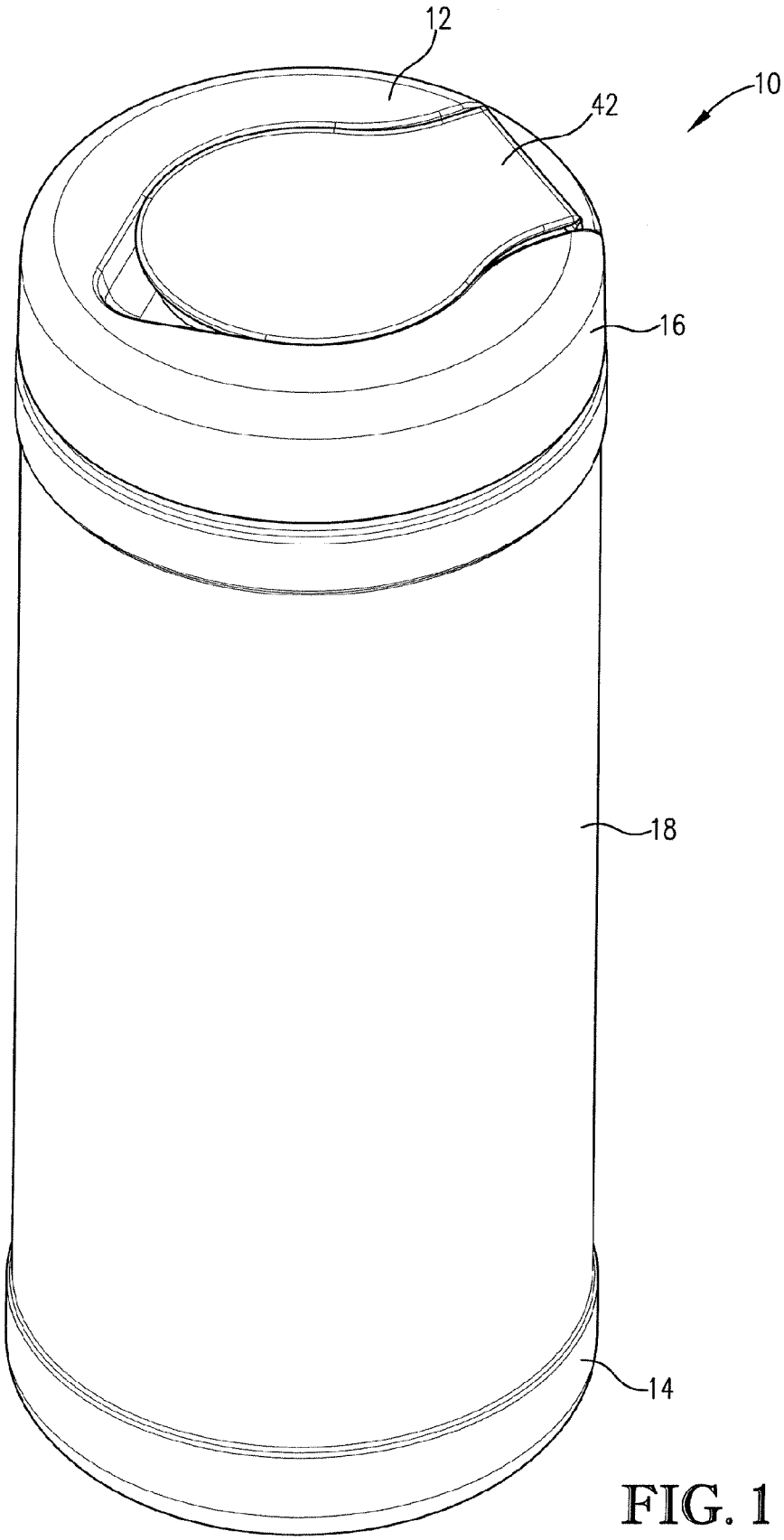
FIG. 1 is a perspective view of an exemplary dispenser according to the invention.

Turning now to the figures, and particularly FIG. 1, a dispenser 10 comprising a lid 12 and container 14 is shown. Lid 12 and container 14 each comprise respective sidewall sections 16, 18. As described in further detail below, lid 12 may be secured to container 14 using any means known in the art, detachable or fixed, however snap-down and screw-down fasteners are preferred.

Figure 2:
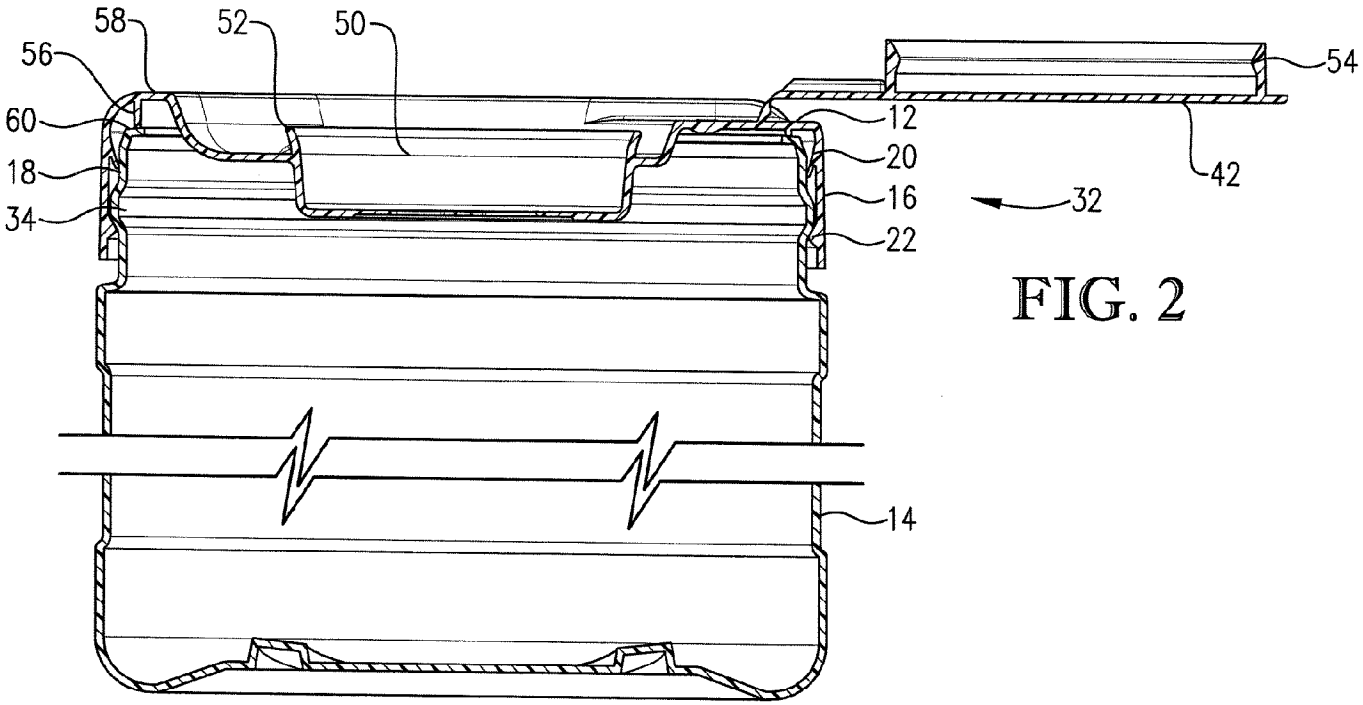
FIG. 2 is a fragmentary cross-sectional view of the dispenser with the lid secured to the container with a snap-down fastening system.
Figure 3:
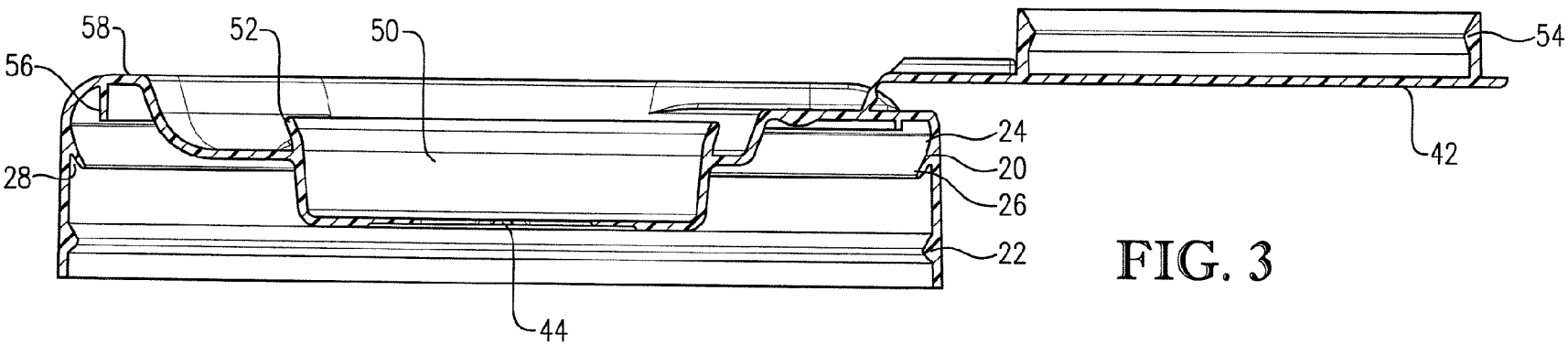
FIG. 3 is a cross-sectional view of the dispenser lid detached from the container.

FIG. 2 is a cross-sectional view of the dispenser 10 showing lid 12 and container 14 secured with a snap-down type fastener. Lid 12 presents two circumferential, inwardly-protruding ridges 20, 22. As shown in FIG. 3, ridge 20 comprises two faces 24, 26 which slope downwardly away from lid sidewall 16. As shown in FIG. 2, faces 24, 26 lie in converging planes, however, it is within the scope of the invention for faces 24, 26 to lie in parallel planes which are oblique with respect to the interior surface of lid sidewall 16. Face 26 cooperates with the interior surface of lid sidewall 16 to form a circumferential undercut channel 28. The internal diameter of ridge 20 is less than the outer diameter of container sidewall section 18 proximate container top orifice 30. When lid 12 is placed over container 14, ridge 20 flexes so as to accommodate the greater diameter of the container sidewall section 18. In so doing, ridge 20 forms a flexible seal between lid 12 and container 14 for preventing moisture loss from a product (not shown) inside container 14.

Lid 12, as shown, is of unitary construction and is preferably formed of a synthetic resin material through an injection molding process. The process wherein ridge 20 is formed is commonly referred to as undercut molding.

In one embodiment, lid 12 is secured to container 14 by a snap-down fastening system 32 comprising ridge 22 and a rib 34 protruding from container sidewall 18. As lid 12 is placed down over container sidewall 18 proximate container orifice 30, ridge 22 encounters rib 34, lid sidewall 16 slightly deforms and ridge 22 is forced over rib 34 into a final locked position shown in FIG. 2. At the same time, ridge 20 is slidably received over container sidewall section 18. Because the internal diameter presented by ridge 20 is less than the outer diameter presented by container sidewall 18 proximate container orifice 30, ridge 20 can accommodate variances in container sidewall 18 outer diameter and effectively provide a seal even though the dimensions of container 14 are not entirely uniform or within previously acceptable manufacturing tolerances.

In the embodiment shown in FIG. 8, lid 12 is secured to container 14 by a screw-down fastening system 36. System 36 comprises a plurality of helically flighted threads 38 formed in the interior surface of lid sidewall 16 and a complimentary set of helically flighted threads 40 formed in container sidewall 18. As lid 12 is placed over container 14 and lid 12 rotated resulting in the mating of threads 38, 40, ridge 20 slidably engages the outer surface of container sidewall 18 thereby forming a nonthreaded, flexible seal between lid 12 and container 14.

FIGS. 4 and 5 depict top and bottom perspective views of lid 12. Lid 12 comprises a hinged flap 42 moveable between an open position (as shown in FIG. 4) and a closed position (shown in FIG. 1). In closed position, flap 42 covers product dispensing port 44 which communicates with the container interior to allow a product stored therein (such as a moist towelette) to be removed. Dispensing port 44 comprises a plurality of intersecting slots 46 formed in a recessed portion 48 of lid 12. It is understood that port 44 could comprise any suitable shape in addition to that depicted in the present figures. The exact design employed in a particular application is dependent upon the material used to make the lid and the product being dispensed from the container. Recess 48 is defined by an upstanding circumferential wall 50 having a flared outermost ridge 52. Flap 42 also comprises a ridge 54 which is slidably received over ridge 52 and locks flap 42 in closed position. Ridges 52 and 54 cooperatively provide a seal to inhibit moisture loss from the container interior through port 44.

Lid 12 also comprises a rib 56 formed in the top wall 58 thereof. Rib 56 acts as a stop in order to prevent lid 12 from being forced too far down container 14. Rib 56 engages the rim 60 of container sidewall 18 proximate orifice 30. Rib 56 also functions to space lid 12 from container 14 and maintain lid 12 in level engagement with container 14.

Container sidewall 18 also comprises a beveled section 62 proximate and downwardly divergent away from rim 60. Beveled section 62 helps facilitate coupling of lid 12 to container 14 and maintains the generally downward sloping orientation of ridge 20 while lid 12 is coupled to container 14. As noted above, generally, container sidewall 18 presents a diameter that is greater than the internal diameter of ridge 20. During coupling of lid 12 and container 14, beveled section 62 enables ridge 20 to slide down over container sidewall 18 while maintaining its downwardly sloping orientation. In the particular embodiment shown, the downwardly sloping orientation of ridge 20 provides the most effective seal between lid 12 and container 14. In the absence of beveled section 62, ridge 20 may frictionally catch on sidewall 18 and distort the orientation of ridge 20 thereby reducing the efficacy of the seal formed between lid 14 and container 14 by ridge 20.

FIGS. 6 and 7 illustrate container 14 detached from lid 12. In particular, the embodiment shown is equipped with rib 34 for use in a snap-down fastening system 32. Container 14 may be made of any material chemically compatible with the particular product being stored therein. Preferably, container 14 comprises a synthetic resin material such as polypropylene, polyethylene, or polyethylene terephthalate (PET) formed by a conventional blow molding process.

What is claimed is:

1. A moist product dispenser comprising:

a container having an interior for storing the moist product and presenting a circumferential container sidewall; and a lid coupled with said container, said lid comprising a top wall and a circumferential lid sidewall presenting an interior surface, said lid including a circumferential, protruding ridge presenting top and bottom faces, said top and bottom faces obliquely projecting from the lid sidewall interior surface in a substantially common axial direction to present a proximal ridge end at the sidewall interior surface and a distal ridge end spaced radially inward from the sidewall interior surface, said ridge contacting the container sidewall and forming a flexible seal between said container and said lid.

2. The dispenser of claim 1, said lid presenting a product dispensing port formed therein, said product dispensing port communicating with said container interior.

3. The dispenser of claim 2, said lid including a hinged flap moveable between a closed position wherein said flap is in covering relationship to said port and an open position whereby said port is uncovered.

4. The dispenser of claim 1, said lid comprising a channel defined by said bottom face and said lid sidewall interior surface.

5. The dispenser of claim 1, said lid having unitary construction and being formed of an injection-molded, synthetic resin material.

6. The dispenser of claim 1, said container presenting a top orifice, a bottom wall, and an outwardly protruding rib formed in the container sidewall proximate said top orifice.

7. The dispenser of claim 6, said ridge engaging the container sidewall between the top orifice and said rib.

8. The dispenser of claim 1, said ridge being in nonthreadable engagement with said container sidewall.

9. The dispenser of claim 1, said container sidewall and said lid comprising complemental threading for securing said lid to said container.

10. The dispenser of claim 1, said container presenting a top orifice and said container sidewall including a beveled section proximate said top orifice.

11. The dispenser of claim 10, said beveled section presenting a downwardly divergent slope away from said top orifice.

12. The dispenser of claim 1, said lid including a circumferential projection extending radially inward from the sidewall interior surface, said projection being spaced from the ridge and engaging the container.

13. The dispenser of claim 12, said projection comprising a thread, said container including a complemental thread projecting from the container sidewall, with the threads threadably engaging one another.

14. In a moist product dispenser comprising a container having an interior for storing the moist product and presenting a circumferential container sidewall, and a lid coupled with the container and presenting a top wall and a circumferential lid sidewall having an interior surface, the improvement comprising:

a circumferential, inwardly protruding ridge provided on the lid sidewall interior surface, said ridge presenting top and bottom faces obliquely projecting from the lid sidewall interior surface in a substantially common axial direction to present a proximal ridge end at the sidewall interior surface and a distal ridge end spaced radially inward from the sidewall interior surface, said ridge engaging the container sidewall and providing a flexible seal between the container and the lid for preventing moisture loss from the container interior.

15. The dispenser of claim 14, the container presenting a top orifice and a bottom wall, and an outwardly protruding rib formed in the container sidewall section proximate the top orifice.

16. The dispenser of claim 15, said ridge engaging the container sidewall section between the top orifice and the rib.

17. The dispenser of claim 14, the lid being of unitary construction.

18. The dispenser of claim 17, the lid being formed of an injection-molded, synthetic resin material.

19. The dispenser of claim 14, said ridge being in nonthreadable engagement with said container sidewall.

20. The dispenser of claim 14, said container sidewall and said lid comprising complemental threading for securing said lid to said container.

21. The dispenser of claim 14, said container presenting a top orifice and said container sidewall including a beveled section proximate said top orifice.

22. The dispenser of claim 21, said beveled section presenting a downwardly divergent slope away from said top orifice.

23. A moist product dispenser comprising:

a container having an interior for storing the moist product and presenting a circumferential container sidewall, and a lid coupled with the container and presenting a circumferential lid sidewall having an interior surface, said lid further presenting a top wall, said lid comprising a dispensing port formed in said top wall communicating with said container interior and a hinged flap moveable between a closed position wherein said flap is in covering relationship to said port and an open position whereby said port is uncovered, said lid further comprising a flexible ridge protruding inwardly from said lid sidewall interior surface and in nonthreaded engagement with said container sidewall and providing a seal between said container and said lid for preventing moisture loss from said container interior, said flexible ridge presenting top and bottom faces obliquely projecting from the lid sidewall interior surface in a substantially common axial direction to present a proximal ridge end at the sidewall interior surface and a distal ridge end spaced radially inward from the sidewall interior surface.

24. The dispenser of claim 23, said port comprising a plurality of intersecting slots.

25. The dispenser of claim 23, said lid secured to said container by a snap-down fastening system.

26. The dispenser of claim 23, said container presenting a top orifice and said container sidewall including a beveled section proximate said top orifice.

27. A moist product dispenser comprising:

a container having an interior for storing the moist product and presenting a circumferential container sidewall; and a lid being coupled with the container, said lid comprising a top wall and a circumferential lid sidewall, at least one of said lid and container including a circumferential, protruding ridge presenting top and bottom faces, said top and bottom faces obliquely projecting from the respective sidewall in a substantially common axial direction to present a proximal ridge end at the sidewall and a distal ridge end spaced radially inward from the sidewall, said ridge contacting the other one of the sidewalls and forming a flexible seal between said container and said lid.

* * * * *